US006933772B1

(12) United States Patent
Banerjee et al.

(10) Patent No.: US 6,933,772 B1
(45) Date of Patent: Aug. 23, 2005

(54) VOLTAGE REGULATOR WITH IMPROVED LOAD REGULATION USING ADAPTIVE BIASING

(75) Inventors: Jaideep Banerjee, Gurgaon (IN); Tushar S Nandurkar, Gurgaon (IN)

(73) Assignee: Freescale Semiconductor, Inc., Austin, TX (US)

( * ) Notice: Subject to any disclaimer, the term of this patent is extended or adjusted under 35 U.S.C. 154(b) by 5 days.

(21) Appl. No.: 10/770,149

(22) Filed: Feb. 2, 2004

(51) Int. Cl.[7] ..... G05F 1/10; G05F 3/02
(52) U.S. Cl. ..... 327/541; 323/277; 323/280
(58) Field of Search ..... 327/530, 538, 327/540–541, 543; 323/273–277, 280

(56) References Cited

U.S. PATENT DOCUMENTS

| | | | | |
|---|---|---|---|---|
| 6,246,221 | B1 | 6/2001 | Xi | 323/280 |
| 6,509,722 | B2 * | 1/2003 | Lopata | 323/280 |
| 6,522,111 | B2 | 2/2003 | Zadeh et al. | 323/277 |
| 6,523,099 | B1 | 2/2003 | Namekawa | 711/163 |

OTHER PUBLICATIONS

Chava et al., "A Robust Frequency Compensation Scheme for LDO Regulators,"*IEEE*, 2002, pp. V-825-V828.

Rincon-Mora et al., "A Low-Voltage, Low Quiescent Current, Low Drop-Out Regulator,"*IEEE Journal of Solid-State Circuits*, vol. 33, No. 1, Jan. 1998, pp. 36-44.

Rincon-Mora et al., "Optimized Frequency-Shaping Circuit Topologies for LDO's,"*IEEE Transactions on Circuits and Systems—II: Analog and Digital Signal Processing*, vol. 45, No. 6, Jun. 1998, pp. 703-708.

Simpson, "A User's Guide to Compensating Low-Dropout Regulators,"*IEEE*, 1997, pp. 270-275.

Stanescu, "A 150mA LDO in 0.8 $\mu$m CMOS Process,"*IEEE*, 2000, pp. 83-86.

Yuan et al., "Low Dropout Voltage Regulator for Wireless Applications,"*IEEE*, 2002, pp. 421-424.

* cited by examiner

*Primary Examiner*—Quan Tra
(74) *Attorney, Agent, or Firm*—Charles E. Bergere

(57) ABSTRACT

A low drop out voltage regulator (10) that receives an input voltage and generates a substantially constant output voltage includes a gain stage (12), a buffer stage (14), an output driver transistor (16), and first and second load current sense circuits (18, 20). The first load current sense circuit is connected between the output driver transistor and the buffer stage and adaptively increases a bias current of the buffer stage as a function of the load current. The second load current sense circuit is connected between the output driver transistor and the gain stage and adaptively decreases a bias current of the gain stage as the load current increases.

19 Claims, 2 Drawing Sheets

VOLTAGE REGULATOR WITH IMPROVED LOAD REGULATION USING ADAPTIVE BIASING

BACKGROUND OF THE INVENTION

The present invention relates generally to power converters and voltage regulators, and more particularly, to a low drop out (LDO) voltage regulator with adaptive biasing.

LDO regulators are widely used in low-voltage, high current applications in many common electronic devices such as cable modems and set-top boxes, and especially in battery-operated electronic devices such as laptop computers, personal digital assistants, and cell phones because they can provide high-performance linear regulation with significant power savings and reduced external component costs. Indeed, the use of LDO regulators is expected to continue to grow as devices become smaller and operating voltages decrease. However, as operating voltages decrease, there is a need for them to be more accurate and more stable.

Accordingly, it would be advantageous to have a low drop out regulator with improved load regulation.

BRIEF DESCRIPTION OF THE DRAWINGS

The following detailed description of a preferred embodiment of the invention will be better understood when read in conjunction with the appended drawings. For the purpose of illustrating the invention, there is shown in the drawings an embodiment that is presently preferred. It should be understood, however, that the invention is not limited to the precise arrangement and instrumentalities shown. In the drawings.

DETAILED DESCRIPTION OF PREFERRED EMBODIMENTS

Figure 1:
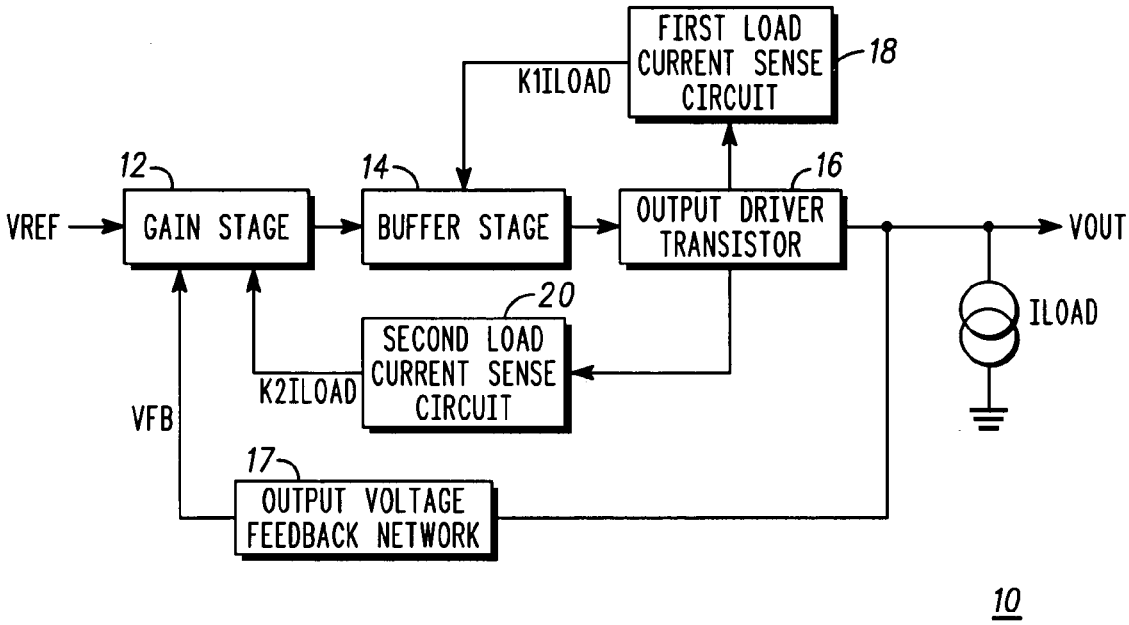
FIG. 1 is a schematic block diagram of a low drop out (LDO) voltage regulator in accordance with an embodiment of the present invention.

The detailed description set forth below in connection with the appended drawings is intended as a description of the presently preferred embodiment of the invention, and is not intended to represent the only form in which the present invention may be practiced. It is to be understood that the same or equivalent functions may be accomplished by different embodiments that are intended to be encompassed within the spirit and scope of the invention. In the drawings, like numerals are used to indicate like elements throughout.

The present invention provides an LDO regulator that uses adaptive current biasing to improve load regulation. The LDO regulator includes a gain stage followed by a buffer stage and an output driver transistor. A load current sense circuit is provided that adaptively reduces the bias current of the gain stage as a function of load current. Thus, at high load currents, which would normally degrade load regulation due to a fall in gain at the driver transistor stage, the current of the gain stage is adaptively decreased, which boosts the gain of the gain stage to compensate for the fall in gain of the driver transistor stage. An additional load current sense circuit may also be included that adaptively increases the bias current of the buffer stage as a function of load current.

In one embodiment, the present invention is a LDO voltage regulator that receives an input voltage and generates a substantially constant output voltage. The voltage regulator includes a gain stage, a buffer stage, an output driver transistor, and a second load current sense circuit. The gain stage receives an input reference voltage and a feedback output voltage and generates a gate voltage. The buffer stage, which is connected to the gain stage, receives the gate voltage and generates a buffered gate voltage. The output driver transistor, which is connected to the buffer stage, receives the buffered gate voltage and generates the substantially constant output voltage and a load current. The second load current sense circuit is connected between the output driver transistor and the gain stage and adaptively decreases a bias current of the gain stage as the load current increases. In an alternative embodiment, a first load current sense circuit is connected between the output driver transistor and the buffer stage and adaptively increases a bias current of the buffer stage as a function of the load current.

Referring now to FIG. 1, a schematic block diagram illustrating a preferred embodiment of a low drop out voltage regulator 10 is shown. The voltage regulator 10 receives an input reference voltage (Vref) and generates a substantially constant output voltage (Vout). The voltage regulator 10 includes a gain stage 12, a buffer stage 14 and an output driver transistor 16. The gain stage 12 receives the input reference voltage (Vref) and a feedback output voltage (Vfb), and generates a gate voltage. The buffer stage 14 is connected in series with the gain stage 10 and receives the gate voltage. The buffer stage 14 then generates a buffered gate voltage. The output driver transistor 16 is connected in series with the buffer stage 14 and receives the buffered gate voltage. The output driver transistor 16 generates the substantially constant output voltage, Vout, and a load current, Iload. An output voltage feedback network 17 is connected between the output driver transistor 16 and the gain stage 12 and provides a feedback voltage (Vfb) to the gain stage 12.

A total gain of the regulator 10 can be expressed as a A=A1 A2 A3, wherein A1 is the gain of the gain stage 12, A2 is the gain of the buffer stage 14, and A3 is the gain of the driver transistor 16. Typically, the buffer stage 14 has a gain of about 1.0. Hence the total gain A is approximately A1 A3. In a typical LDO architecture, A1 is nearly constant and A3, the gain of the driver transistor, is inversely proportional to the square root of the load current (Iload). Thus, $A3 \propto 1/\sqrt{Iload}$. At high load currents, the gain A3 is reduced and thus, the total gain is reduced. However, instead of using adaptive biasing to increase the bias current of the gain stage 12, in one embodiment, the present invention includes a first load current sense circuit 18 that increases the bias current of the buffer stage 14. This is because it has been found that increasing the bias current of the gain stage 12, although it improves the transient response of the voltage regulator 10, it causes the gain A1 at the gain stage 12 to fall. In contrast, providing a current feedback to the buffer stage 14 improves transient response and stability of the voltage regulator 10. The first load current sense circuit 18 is connected between the output driver transistor 16 and the buffer stage 14 for adaptively increasing a bias current of the buffer stage 14 as a function of the load current. It is noted, however, that the first current load sense circuit 18 and the feedback bias current generated thereby (K1*Iload) is not necessary for the present invention to work. Without the K1*Iload signal, the bias current at the buffer stage 14 is kept high for improved transient response and stability.

Although the first load current sense circuit 18 improves stability and transient response and the gain A1 at the gain stage 12 remains constant, the gain A3 at the driver transistor 16 falls as the load current Iload increases. In order to reduce the effect of reduced gain at high load currents, a second load current sense circuit 20 is provided for adaptively decreasing a bias current of the gain stage as the load current increases. The second load current sense circuit 20 is connected between the output driver transistor 16 and the gain stage 12 and provides the feedback output voltage to the gain stage 12.

The first load current sense circuit 18 increases the bias current of the buffer stage by a factor of K1 times the load current (K1*Iload), where K1 is less than 1.0. The second load current sense circuit 20 decreases the bias current of the gain stage by a factor of K2 times the load current (K2*Iload), where K2 is less than 1.0.

Figure 2:
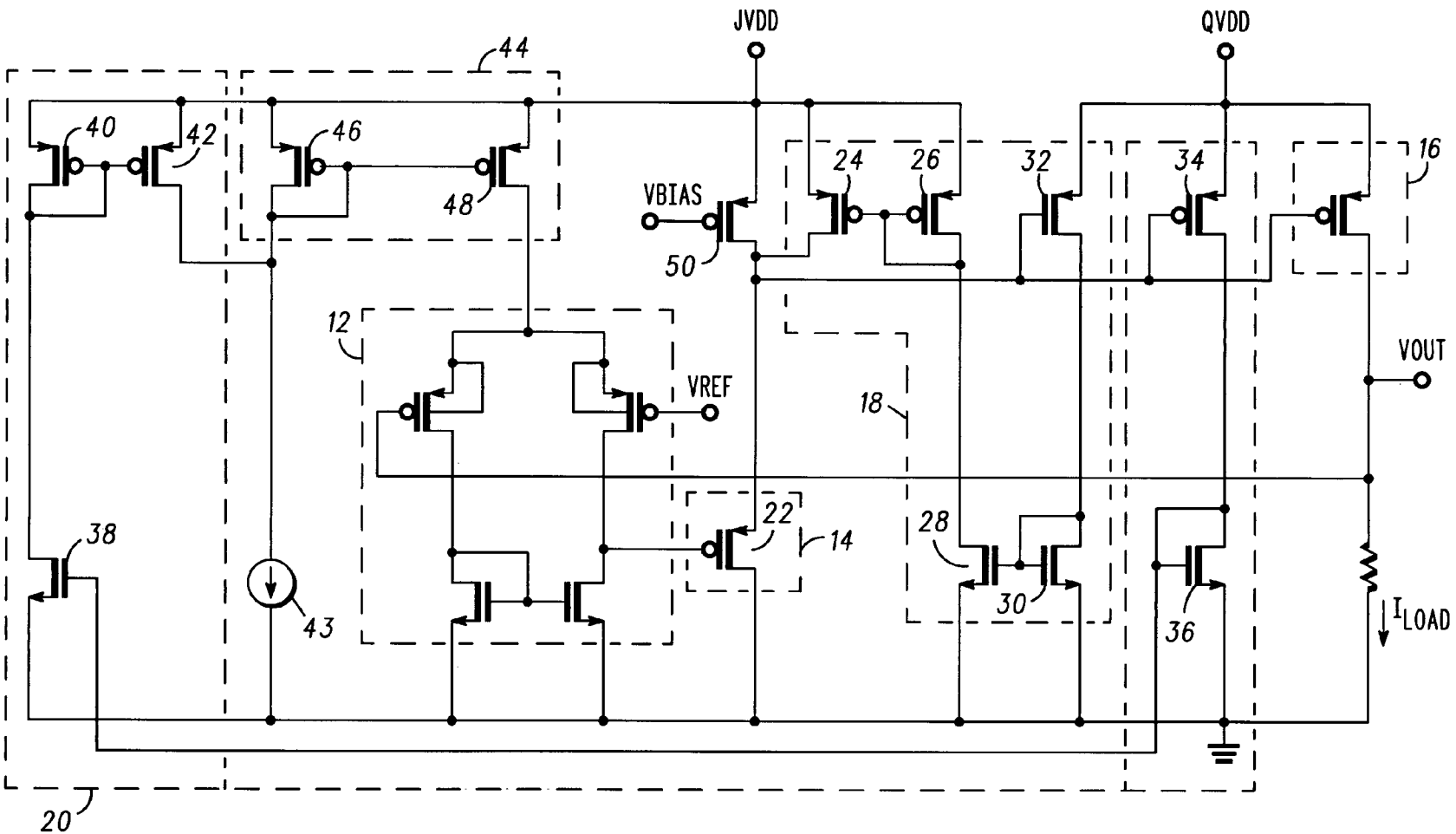
FIG. 2 is a schematic circuit diagram of an implementation of the LDO regulator of FIG. 1.

Referring now to FIG. 2, a schematic circuit diagram of an implementation of the LDO regulator 10 is shown. The gain stage 12 is a differential amplifier circuit that receives the input voltage Vref and the feedback voltage (Vfb), which in the present example is the output voltage Vout. However, the feedback voltage could be any other voltage that is a function of Vout. The buffer stage 14 is a source follower and preferably comprises a first PMOS transistor 22 having a gate connected to the gain stage 12, a source connected to a gate of the output driver transistor 16, and a drain connected to a second supply voltage Vss (e.g., ground). The output driver transistor 16 has a source connected to a first power supply qVdd and a drain connected to the gain stage 12. The drain of the output driver transistor 16 connection to the gain stage 12 provides the feedback voltage Vfb to the gain stage 12. The first power supply may comprise a single source Vdd, or two or more sources, as shown, indicated as jVdd and qVdd.

The first load current sense circuit 18 includes second and third PMOS transistors 24 and 26, first and second NMOS transistors 28 and 30, and a fourth PMOS transistor 32. The second PMOS transistor 24 has a source connected to the first supply voltage jVdd and a drain connected to the source of the first PMOS transistor 22. The third PMOS transistor 26 has a source connected to the first supply voltage jVdd, a drain connected to the gate of the second PMOS transistor 24, and a gate also connected to the gate of the second PMOS transistor 24. The first NMOS transistor 28 has a drain connected to the drain of the third PMOS transistor 26 and a source connected to the second supply voltage. The second NMOS transistor 30 has a gate connected to a gate of the first NMOS transistor 28, a drain connected to its own gate and the gate of the first NMOS transistor 28, and a source connected to the second supply voltage. The fourth PMOS transistor 32 has a gate connected to the source of the first PMOS transistor 22 and to the gate of the output driver transistor 16, a drain connected to the drain of the second NMOS transistor 30, and a source connected to the first supply voltage qVdd.

The second load current sense circuit 20 includes a fifth PMOS transistor 34, a third NMOS transistor 36, a fourth NMOS transistor 38, and sixth and seventh PMOS transistors 40 and 42. The fifth PMOS transistor 34 has a gate connected to the source of the first PMOS transistor 22, as well as to the gates of the fourth PMOS transistor 32 and the output driver transistor 16. The fifth PMOS transistor 34 also has a source connected to the first supply voltage qVdd. The third NMOS transistor 36 has a drain connected to the drain of the fifth PMOS transistor 34, a gate connected to its drain, and a source connected to the second supply voltage Vss. The fourth NMOS transistor 38 has a gate connected to the gate of the third NMOS transistor 36, and a source connected to the second supply voltage Vss. The sixth PMOS transistor 40 has a source connected to the first supply voltage jVdd, a drain connected to a drain of the fourth NMOS transistor 38, and a gate connected to its drain. The seventh PMOS transistor 42 has a source connected to the first supply voltage jVdd, a drain connected to a current source 43, and a gate connected to the gate of the sixth PMOS transistor 40.

The voltage regulator 10 also includes a current bias circuit 44 connected to the gain stage 12. The current bias circuit 44 includes an eighth PMOS transistor 46 and a ninth PMOS transistor 48. The eighth PMOS transistor 46 has a source connected to the first supply voltage jVdd and a drain connected to the current source 43. The gate of the eighth PMOS transistor 46 is connected to its drain. The ninth PMOS transistor 48 has a source connected to the first supply voltage jVdd, a drain connected to the gain stage 12, and a gate connected to the gate of the eighth PMOS transistor 46.

The voltage regulator 10 may also include a current bias transistor 50 having a source connected to the first supply voltage jVdd, a drain connected to the buffer stage 14, and a gate connected to a bias voltage Vbias. More particularly, the drain of the current bias transistor 50 is connected to the source of the first PMOS transistor 22, the source of the second PMOS transistor 24, the gates of the fourth and fifth PMOS transistors 32 and 34, and the gate of the output driver transistor 16. The purpose of the current bias transistor 50 is to bias the source follower first PMOS transistor 22. However, as will be understood by those of skill in the art, the biasing of the first PMOS transistor 22 can be achieved in other ways. Also if the first load current sense circuit 18 is used, then depending on the minimum load current to the regulator 10, the current bias transistor 50 may not be required.

Figure 3:
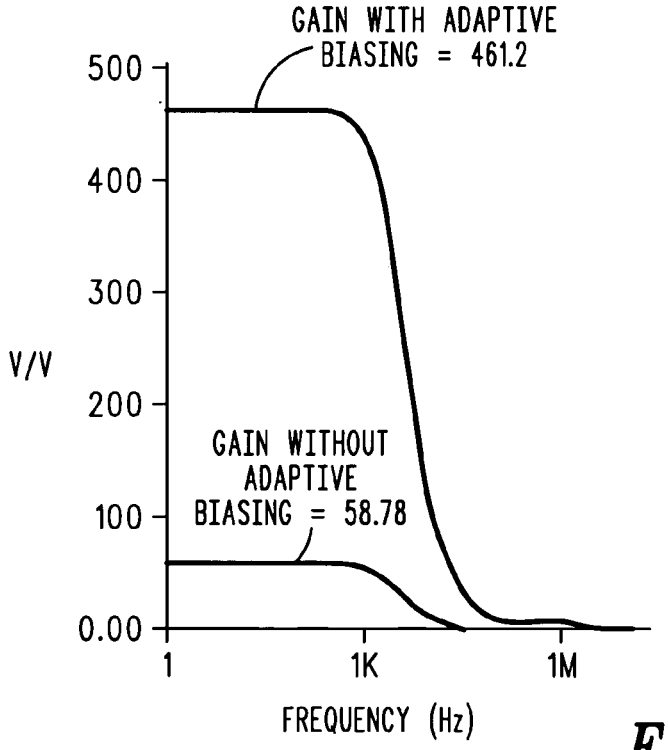
FIG. 3 is a graph illustrating the open loop gain of the LDO regulator of FIG. 2 with adaptive biasing compared to the open loop gain without adaptive biasing according to a first manufacturing process.

Referring now to FIG. 3, a graph illustrating the open loop gain of the LDO voltage regulator 10 of FIG. 2 with adaptive biasing compared to the open loop gain without adaptive biasing is shown. More particularly, the graph shows the simulation results for the voltage regulator 10 fabricated using CMOS 90 technology. The input reference voltage, Vref, was 1.2 V, a feedback factor β was kept at unity and a load current of 300 mA was applied on the regulator 10. The initial bias current, without adaptive biasing, to the gain stage was 60 uA, which resulted in an open loop gain of 58 V/V. With adaptively reducing the bias current of the gain stage to 12.2 uA, an open loop gain of 461 V/V was achieved, which is an eight times improvement in the open loop gain. This resulted in an improvement of load regulation from 1.7% to 0.3%.

The LDO voltage regulator 10 is simple in design and can be easily be implemented in any CMOS/BiCMOS technology. The current efficiency of the regulator 10 is not affected by the circuit technology. The voltage regulator 10 can be used in any application that requires good load regulation. The description of the preferred embodiment of the present invention has been presented for purposes of illustration and description, but is not intended to be exhaustive or to limit the invention to the form disclosed. Thus, changes could be made to the embodiment described above without departing from the inventive concept thereof. It is understood, therefore, that this invention is not limited to the particular embodiment disclosed, but covers modifications within the spirit and scope of the present invention as defined by the appended claims.

What is claimed is:

1. A low drop out voltage regulator that receives an input voltage and generates a substantially constant output voltage, comprising:

a gain stage that receives an input reference voltage and a feedback output voltage and generates a gate voltage;

a buffer stage, connected to the gain stage, that receives the gate voltage and generates a buffered gate voltage;

an output driver transistor, connected to the buffer stage, that receives the buffered gate voltage and generates the substantially constant output voltage and a load current; and a second load current sense circuit connected between the output driver transistor and the gain stage for adaptively decreasing a bias current of the gain stage as the load current increases.

2. The voltage regulator of claim 1, wherein the second load current sense circuit decreases the bias current of the gain stage by a factor of K2 times the load current.

3. The voltage regulator of claim 2, wherein K2 is less than 1.0.

4. The voltage regulator of claim 1, further comprising a first load current sense circuit connected between the output driver transistor and the buffer stage for adaptively increasing a bias current of the buffer stage as a function of the load current.

5. The voltage regulator of claim 4, wherein the first load current sense circuit increases the bias current of the buffer stage by a factor of K1 times the load current.

6. The voltage regulator of claim 5, wherein K1 is less than 1.0.

7. The voltage regulator of claim 1, wherein the gain stage comprises a differential amplifier circuit.

8. The voltage regulator of claim 7, wherein the buffer stage comprises a first PMOS transistor having a gate connected to the gain stage, a source connected to a gate of the output driver transistor, and a drain connected to a second supply voltage.

9. The voltage regulator of claim 8, wherein the output driver transistor has a gate connected to a source of the first PMOS transistor, a source connected to a first power supply, and a drain connected to the gain stage for providing the feedback output voltage to the gain stage.

10. The voltage regulator of claim 9, wherein the second load current sense circuit comprises:

a fifth PMOS transistor having a gate connected to the source of the first PMOS transistor, and a source connected to the first supply voltage;

a third NMOS transistor having a drain connected to the drain of the fifth PMOS transistor, a gate connected to its drain, and a source connected to the second supply voltage;

a fourth NMOS transistor having a gate connected to the gate of the third NMOS transistor, and a source connected to the second supply voltage;

a sixth PMOS transistor having a source connected to the first supply voltage, a drain connected to a drain of the fourth NMOS transistor, and a gate connected to its drain; and a seventh PMOS transistor having a source connected to the first supply voltage, a drain connected to a current source, and a gate connected to the gate of the sixth PMOS transistor.

11. The voltage regulator of claim 10, further comprising a first load current sense circuit connected between the output driver transistor and the buffer stage for adaptively increasing a bias current of the buffer stage as a function of the load current, wherein the first load current sense circuit comprises:

a second PMOS transistor having a source connected to the first supply voltage and a drain connected to the source of the first PMOS transistor;

a third PMOS transistor having a source connected to the first supply voltage, a drain connected to a gate of the second PMOS transistor, and a gate connected to the gate of the second PMOS transistor;

a first NMOS transistor having a drain connected to the drain of the third PMOS transistor, and a source connected to the second supply voltage;

a second NMOS transistor having a gate connected to a gate of the first NMOS transistor, a drain connected to the gate of the first NMOS transistor, and a source connected to the second supply voltage; and a fourth PMOS transistor having a gate connected to the source of the first PMOS transistor, a drain connected to the drain of the second NMOS transistor, and a source connected to the first supply voltage.

12. The voltage regulator of claim 11, wherein the first supply voltage comprises a positive voltage supply and the second supply voltage comprises a ground.

13. The low drop out voltage regulator of claim 12, further comprising a current bias circuit connected to the gain stage.

14. A low drop out voltage regulator that receives an input voltage and generates a substantially constant output voltage, comprising:

a gain stage that receives an input reference voltage and a feedback output voltage and generates a gate voltage;

a buffer stage including a first PMOS transistor having a gate connected to the gain stage for receiving the gate voltage, a source connected to a first supply voltage by way of a current bias transistor, and a drain connected to a second supply voltage, wherein the buffer stage generates a buffered gate voltage at its source;

an output driver transistor having a gate connected to the source of the buffer stage for receiving the buffered gate voltage, a source connected to the first supply voltage, and a drain connected to the gain stage for providing the feedback voltage thereto, wherein the drain provides the substantially constant output voltage and a load current; and a second load current sense circuit connected between the output driver transistor and the gain stage for adaptively decreasing a bias current of the gain stage as the load current increases.

15. The voltage regulator of claim 14, wherein the second load current sense circuit comprises:

a fifth PMOS transistor having a gate connected to the source of the first PMOS transistor, and a source connected to the first supply voltage;

a third NMOS transistor having a drain connected to the drain of the fifth PMOS transistor, a gate connected to its drain, and a source connected to the second supply voltage;

a fourth NMOS transistor having a gate connected to the gate of the third NMOS transistor, and a source connected to the second supply voltage;

a sixth PMOS transistor having a source connected to the first supply voltage, a drain connected to a drain of the fourth NMOS transistor, and a gate connected to its drain; and a seventh PMOS transistor having a source connected to the first supply voltage, a drain connected to a current source, and a gate connected to the gate of the sixth PMOS transistor.

16. The low drop out voltage regulator of claim 15, further comprising a current bias circuit connected to the gain stage.

17. The voltage regulator of claim 16, further comprising a first load current sense circuit connected between the output driver transistor and the buffer stage for adaptively increasing a bias current of the buffer stage as a function of the load current.

18. The voltage regulator of claim 17, wherein the first load current sense circuit comprises:

a second PMOS transistor having a source connected to the first supply voltage and a drain connected to the source of the first PMOS transistor;

a third PMOS transistor having a source connected to the first supply voltage, a drain connected to a gate of the second PMOS transistor, and a gate connected to the gate of the second PMOS transistor;

a first NMOS transistor having a drain connected to the drain of the third PMOS transistor, and a source connected to the second supply voltage;

a second NMOS transistor having a gate connected to a gate of the first NMOS transistor, a drain connected to the gate of the first NMOS transistor, and a source connected to the second supply voltage; and a fourth PMOS transistor having a gate connected to the source of the first PMOS transistor, a drain connected to the drain of the second NMOS transistor, and a source connected to the first supply voltage.

19. A low drop out voltage regulator that receives an input voltage and generates a substantially constant output voltage, comprising:

a gain stage that receives an input reference voltage and a feedback output voltage and generates a gate voltage;

a buffer stage, connected to the gain stage, that receives the gate voltage and generates a buffered gate voltage;

an output driver transistor, connected to the buffer stage, that receives the buffered gate voltage and generates the substantially constant output voltage and a load current; and a second load current sense circuit connected between the output driver transistor and the gain stage for adaptively decreasing a bias current of the gain stage as the load current increases, wherein the second load current sense circuit comprises:

a fifth PMOS transistor having a gate connected to the source of the first PMOS transistor, and a source connected to the first supply voltage;

a third NMOS transistor having a drain connected to the drain of the fifth PMOS transistor, a gate connected to its drain, and a source connected to the second supply voltage;

a fourth NMOS transistor having a gate connected to the gate of the third NMOS transistor, and a source connected to the second supply voltage;

a sixth PMOS transistor having a source connected to the first supply voltage, a drain connected to a drain of the fourth NMOS transistor, and a gate connected to its drain; and a seventh PMOS transistor having a source connected to the first supply voltage, a drain connected to a current source, and a gate connected to the gate of the sixth PMOS transistor.

* * * * *